United States Patent [19]

Wirz

[11] 4,120,244

[45] Oct. 17, 1978

[54] GRIPPER MOVEMENT CHANGEOVER DEVICE ON A SHEET-TURNING DRUM FOR PERFECTOR PRINTING MACHINES

[75] Inventor: Arno Wirz, Bammental, Germany

[73] Assignee: Heidelberger Druckmaschinen Aktiengesellschaft, Heidelberg, Germany

[21] Appl. No.: 765,903

[22] Filed: Feb. 7, 1977

[30] Foreign Application Priority Data

Feb. 7, 1976 [DE] Fed. Rep. of Germany ..... 2604895

[51] Int. Cl.[2] ..... B41F 21/04

[52] U.S. Cl. ..... 101/230; 101/409; 74/471 R; 271/82; 271/277

[58] Field of Search ..... 101/230–232, 101/407–411; 74/471 R; 271/82, 277

[56] References Cited

U.S. PATENT DOCUMENTS

| | | | |
|---|---|---|---|
| 3,055,445 | 9/1962 | Mendez et al. | 74/471 R |
| 3,095,750 | 7/1963 | Mahn | 74/471 R |
| 3,145,257 | 8/1964 | Suga | 74/471 R |
| 3,675,748 | 7/1972 | Hansen | 74/471 R |
| 3,796,154 | 3/1974 | Weisgerber | 101/232 |
| 3,929,069 | 12/1975 | Jahn | 271/277 |
| 3,985,074 | 10/1976 | Bonsch | 271/277 |
| 4,014,261 | 3/1977 | Becker | 101/230 |

FOREIGN PATENT DOCUMENTS

| | | | |
|---|---|---|---|
| 2,414,998 | 10/1975 | Fed. Rep. of Germany | 101/231 |

*Primary Examiner*—William Pieprz
*Attorney, Agent, or Firm*—Herbert L. Lerner

[57] ABSTRACT

Gripper movement changeover device on a sheet-turning drum for perfector printing machines having drive members for the gripper movement pivotable about pivot pins, each of the drive members carrying a roller selectively engageable with coaxially disposed control cams for following the same, includes a bridge disposed in a cavity formed in the sheet-turning drum, the bridge extending over the length of the sheet-turning drum, the drive members being mounted in the bridge, the bridge being longitudinally displaceable a distance corresponding to the mutual spacing of the control cams of the respective drive members.

5 Claims, 6 Drawing Figures

GRIPPER MOVEMENT CHANGEOVER DEVICE ON A SHEET-TURNING DRUM FOR PERFECTOR PRINTING MACHINES

The invention relates to a gripper movement changeover device on a sheet-turning drum for perfector printing machines, and more particularly, such a device having drive members for the gripper movement pivotable about pivot pins, each of the drive members carrying a roller cam follower selectively engageable with coaxially disposed control cams.

In a heretofore known construction of this general type (German Published Prosecuted Patent Application DT-AS 24 14998) roller cam followers at the end faces of the turning drum are individually adjustable with respect to the control cams. In this regard, it is necessary, when changing over from printing on a single side of a sheet (rectoprinting) to printing on both sides of a sheet (perfector printing) or vice versa in a perfector printing machine, that a respective roller cam follower on each end face of the turning drum be brought into engagement with the corresponding control cam. A disadvantage of such a changeover is that when only one roller cam follower is adjusted, disturbances and faults can occur in the movement of the grippers and, consequently, in the transport of the sheet.

Another heretofore known changeover device for the gripper movement is disclosed in German Published Prosecuted Patent Application DT-AS 2 133 693, wherein the control cams are displaced with respect to the roller cam followers and the drum bearings. This known construction has a disadvantage in that a very high precision is required in producing the control cams and the drum bearings in order to minimize bearing play therebetween. Furthermore, this changeover requires a large complex adjusting mechanism also subject to bearing play, and which is costly and susceptible to disruption and breakdown.

It is accordingly an object of the invention to provide a gripper movement changeover device which avoids the foregoing disadvantages of the heretoforeknown devices of this general type, and with which disturbances in sheet transport are virtually eliminated and changeover between single-side rectoprinting and double-side perfector printing is simplified without impairing transfer of the sheet in registry.

With the foregoing and other objects in view, there is provided, in accordance with the invention, a gripper movement changeover device on a sheet-turning drum for perfector printing machines having drive members for the gripper movement pivotable about pivot pins, each of the drive members carrying a roller selectively engageable with coaxially disposed control cams for following the same, comprising a bridge disposed in a cavity formed in the sheet-turning drum, the bridge extending over the length of the sheet-turning drum, the drive members being mounted in the bridge, the bridge being longitudinally displaceable a distance corresponding to the mutual spacing of the control cams of the respective drive members. A result of such a construction in accordance with the invention is that simultaneous adjustment of both roller cam followers is attained with minimal engineering costs and, moreover, stable mounting of the control and drive members is achieved, thereby assuring registry.

In accordance with another feature of the invention, the device includes axially aligned pivot means disposed in respective end faces of the bridge for mounting the drive members, and torsion bar spring means for stressing or biasing the axially aligned pivot means against one another. With such a construction, the changeover device is accommodatable in minimal space within the drum.

In accordance with a further feature of the invention, the device includes a slotted plate fastened in the cavity, and an eccentric bolt mounted in the bridge and having an eccentric pin engaging in the slotted plate.

Relatively easy and rapid shifting or displacement of the bridge by the operator or servicing personnel is thereby afforded. By means of rotating the eccentric bolt, the bridge can thus be shifted into one or the other of the two end positions thereof.

In accordance with an additional feature of the invention which affords a further relatively simple and reliable adjustment of the bridge, a first bearing is secured in the cavity, a second bearing is secured to the bridge, and a threaded spindle is threadedly fastened at one end thereof in the first bearing and rotatably mounted at the other end thereof in the second bearing and secured thereat against axial displacement.

In accordance with concomitant features of the invention, the device includes slide means or roller means for, respectively, slidably or rollably guiding the bridge in the cavity, eccentric bolt means for adjusting the respective slide means or roller means with respect to the bridge, and threaded fastening means for tightly securing the bridge in the cavity. With this construction, virtually exact guidance of the bridge in the drum and reliable and secure fastening of the bridge are achieved.

Other features which are considered as characteristic for the invention are set forth in the appended claims.

Although the invention is illustrated and described herein as embodied in a gripper movement changeover device on a sheet-turning drum for perfector printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
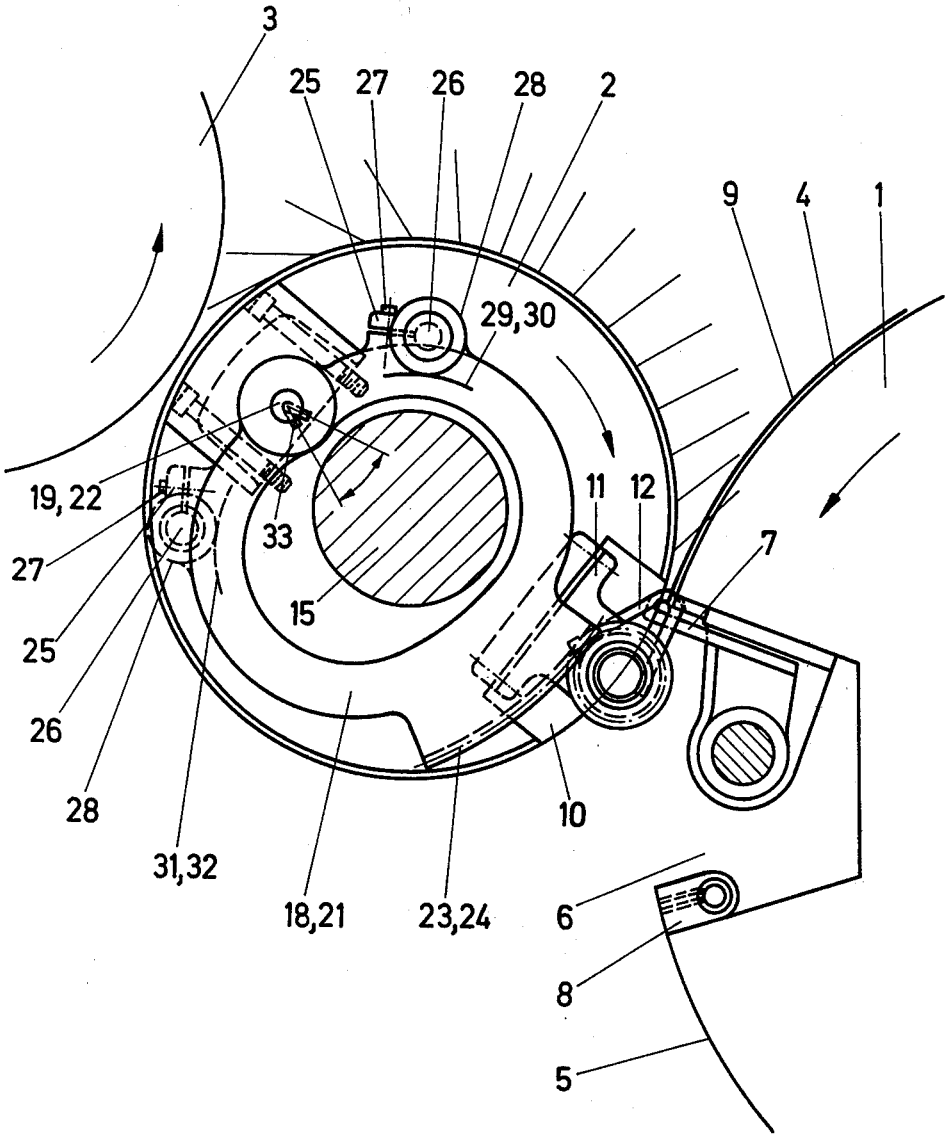
FIG. 1 is a diagrammatic side elevational view of the sheet-turning device for perfector printing machines in single-side or recto-printing position.

Referring now to the drawing and first, particularly, to FIG. 1 thereof, there is shown a sheet-turning device according to the invention provided in an assembly of a transfer drum 1 and a turning drum 2, the latter being disposed between the transfer drum 1 and a succeeding impression cylinder 3. The additional cylinders of the printing units, between which the sheet-turning device of the invention is provided, are not shown in the drawing. In the interest of clarity, a further delivery or transfer drum, which should lie between the non-illustrated preceding printing unit and the transfer drum 1 has been omitted from FIG. 1

The transfer drum 1 has two sheet guidance surfaces 4 and 5. They are separated from one another by two diametrically opposing drum channels 6, only one of which is shown in FIG. 1. In the respective drum channels 6, grippers 7 are provided at one wall thereof and on the opposite wall therefrom, a suction bar 8 extends along the entire width of the drum 1. A sheet 9 that has been printed on one side thereof is disposed on the sheet guidance surface 4 of the transfer drum 1, the leading edge of the sheet 9 being held by grippers 7 while the trailing end of the sheet 9 is held by the suction bar 8 that is located at the end of the sheet guidance surface 4.

Since the turning drum 2 has only half the diameter of the transfer drum 1, it therefore possesses only one drum channel 10 wherein bearings 11 for tongs-gripper halves 12, 12' (see FIG. 2) are mounted. In a non-illustrated channel formed in the impression cylinder 3, corresponding grippers are similarly provided.

Figure 2:
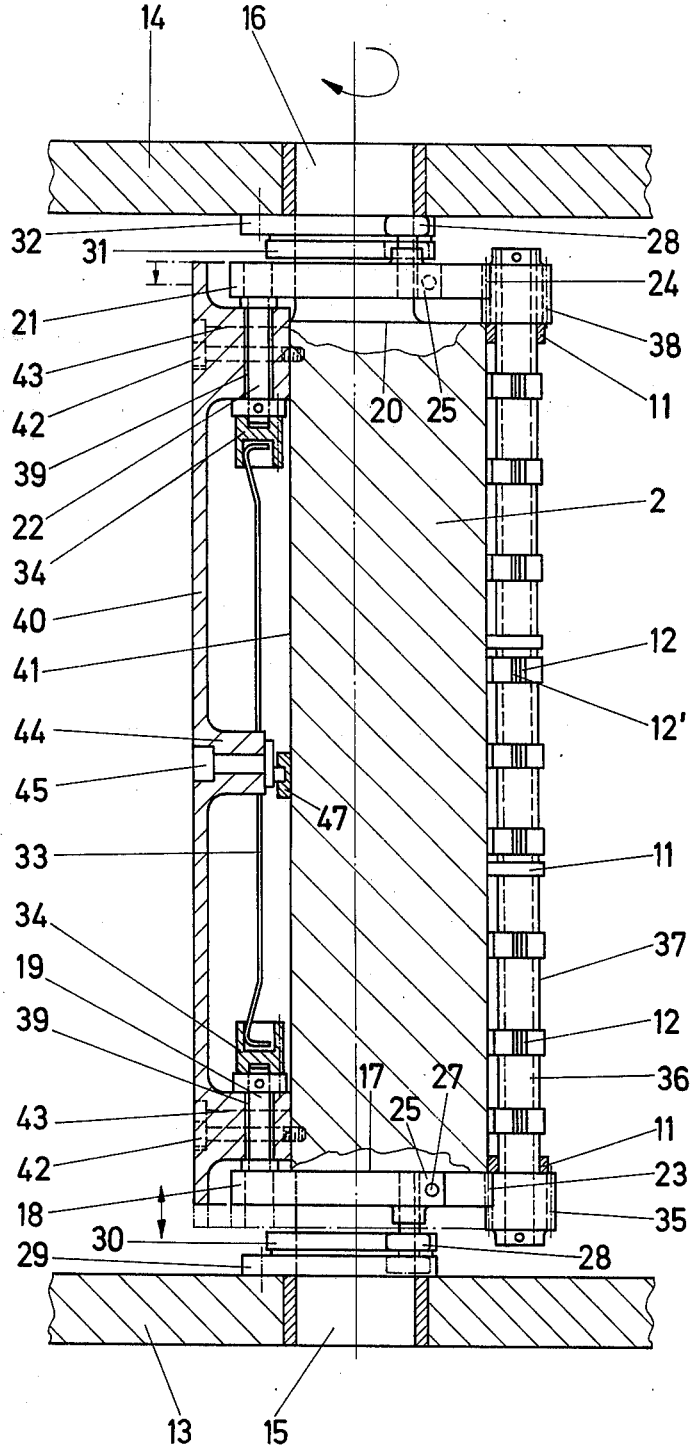
FIG. 2 is a longitudinal sectional view of the sheet-turning device.

In FIG. 2, the assembly of drums or cylinders 1 to 3 incorporating the sheet-turning device according to the invention are shown mounted in side walls 13 and 14 of the printing machine, the sheet-turning drum 2, in fact, by means of shaft pins 15 and 16. The drive of the turning drum 2 is effected by a non-illustrated drive gear that is mounted on a similarly non-illustrated shaft.

A drive member 18 for the tongs-gripper halves 12 is located between an end wall 17 of the turning drum 2 and the side wall 13 of the printing machine from which the drive for the turning drum 2 is applied. The drive member 18 is rotatably mounted on a pin 19. On the operator's side of the printing machine, a corresponding drive member 21 for the tongs-gripper halves 12' are disposed between the other end wall 20 of the sheet-turning drum 2 and the side wall 14. The drive member 21 is also pivotally mounted on a pin 22. Both drive members 18 and 21, respectively, surround the shaft pins 15 and 16 of the turning drum 2.

The specific construction and shape of the drive members 18 and 21 are apparent, in detail, from FIG. 1. Both drive members 18 and 21 have a respective toothed segment 23 and 24 at the ends thereof located opposite the respective pins 19 and 22.

As shown in FIG. 1, a slotted eye journal bearing 25 is provided above the pin 19 in the drive member 18, a bolt 26 being disposed in the eye bearing 25 and being rigidly clampable by means of a clamping screw 27. The eye bearing 25 need not be slotted, in which case the bolt 26 is suitably pinned. A roller 28 is rotatably mounted on the bolt 26 and can selectively cooperate with two control cams 29 and 30. Both of the control cams 29 and 30 are fastened to the inside of the side wall 13 coaxially to the sheet-turning drum 2.

Similar control means are provided on the opposite or operator's side of the printing machine from that viewed in FIG. 1. The slotted eye journal bearing 25 for the bolt 26 of the roller 28 is not found thereat above, however, but rather below the pin 22, because the drive member 21 at the other side of the turning drum 2 is disposed as a mirror image of the drive member 18, as shown in the broken-line representation thereof in FIG. 1. Two control cams 31 and 32 are also fastened to the side wall 20 coaxially to the turning drum 2 between the side wall 14 and the drive member 21. The roller 28 can be brought into engagement with either of the two control cams 31 and 32.

A torsion bar spring 33 extending within a bridge 40 acts upon the drive members 18 and 21, respectively, in such a manner that the rollers 28 thereof are always pressed against the respective control cams 29 and 30, on the one hand and 31 and 32, on the other hand. The torsion bar spring 33 is mounted in spring bearings 34 that are, in turn, fastened to the pins 19 and 22. Due to the torque of the torsion bar spring 33, both drive members 18 and 21 are stressed in opposition to one another over the pins 19 and 22.

The toothed segment 23 of the drive member 18 meshes with a gear 35 which is firmly connected to a gripper bar or shaft 36. The gripper shaft 36 extends coaxially through a gripper tube 37 and is rotatably journalled therein, as is apparent from the details shown in FIG. 2. The gripper tube 37 extends along the channel 10 of the turning drum 2 and is rotatably journalled in the hereinaforementioned bearings 11. On the operator's side of the printing machine i.e. at the top of FIG. 2, a gear 38 is fastened to the free end of the gripper tube 37 and meshes with the toothed segment 24 of the drive member 21 and, with respect to the number of teeth thereof, corresponds fully to the aforementioned gear 35. Both drive members 18 and 21 control the movement of the tongs-gripper halves 12 and 12' and, accordingly, the respective control cams 29 and 30, on the one hand, and 31 and 32, on the other hand, by means of the toothed segments 23 and 24 and the gears 35 and 38.

The drive members 18 and 21 are mounted over the pins 19 and 22 and bearing bushings 39 in the bridge 40 which extends over the length of the body of the drum 2. The bridge 40 is fastened by means of screws 42 in a cavity or recess 41 formed in the drum body 2. The screws 42 are disposed in slots 43 which permit longitudinal displacement of the bridge 40. It is thereby possible to adjust both rollers 28 in common from the cams 30 and 32 to the cams 29 and 31.

Figure 3:
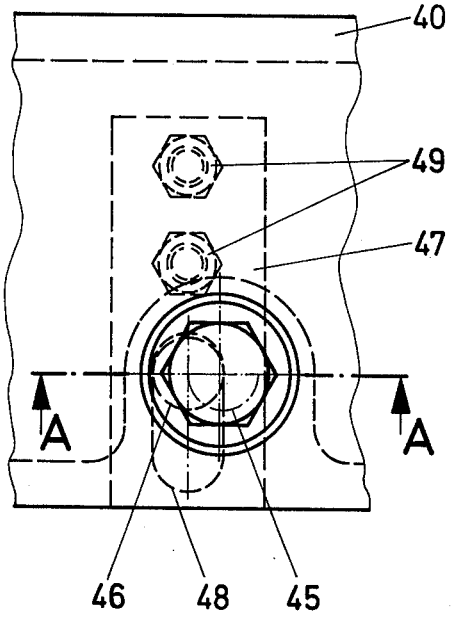
FIG. 3 is a fragmentary enlarged top plan view of FIG. 2 showing an adjusting device of the sheet-turning device.
Figure 4:
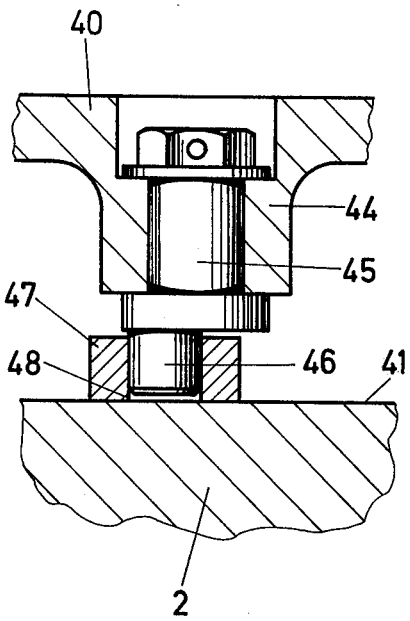
FIG. 4 is a cross-sectional view of FIG. 3 taken along the line A—A in the direction of the arrows.

To displace or shift the bridge 40 longitudinally, an eccentric bolt 45 is rotatably mounted in an eye bearing 44 at the underside thereof and has an eccentric pin or trunnion 46 engaging in a slotted plate 47 (FIGS. 3 and 4) secured in the cavity 41. The slot 48 formed in the slotted plate 47 is of such dimensions that the eccentric bolt 45 can execute a turn of 180° and thereby shifts the bridge 40 in accordance with the spacing of both control cams 29 and 30 on the one hand, and 31 and 32 on the other hand. The slotted plate 47 is fastened by means of screws 49 in the pit 41.

Figure 5:
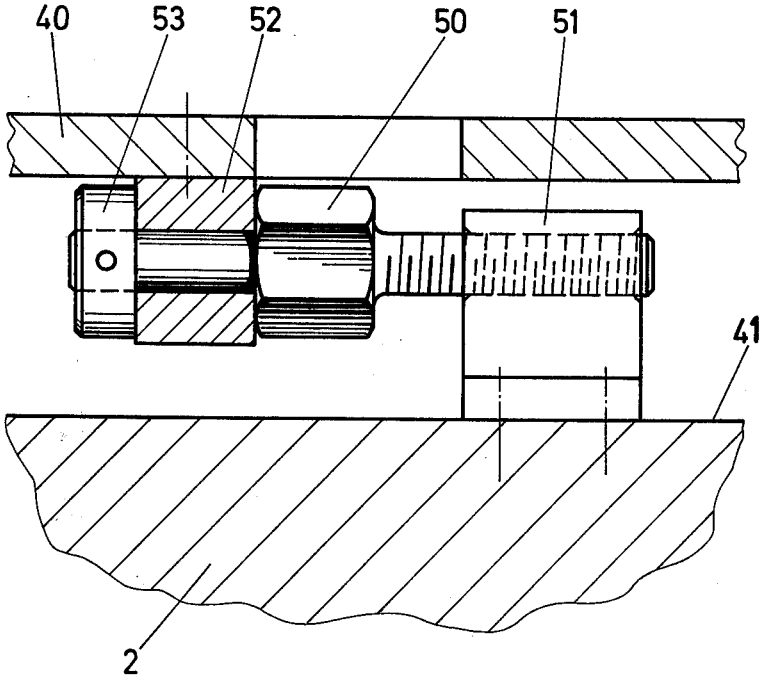
FIG. 5 is a longitudinal sectional view of another embodiment of the adjusting device.

Another embodiment of the adjusting device for longitudinally shifting the bridge 40 is shown in FIG. 5 and employs a threaded spindle 50, the threaded shank of which is screwed into a bearing 51 which is fastened in the cavity 41. The other end of the spindle 50 is rotatably mounted in another bearing 52 which is fastened to the underside of the bridge 40. An adjusting ring 53 serves for securing the threaded spindle 50 in the bearing 52 against axial displacement. By turning the threaded spindle 50 according to FIG. 5, the bridge 40 is shiftable, in the illustrated embodiment, toward the right-hand side of the figure by a distance corresponding to the mutual spacing of the control cams. When restoring the bridge 40 to the position thereof shown in FIG. 5, the adjustment is limited by the length of the slot 43. With both embodiments of adjustment devices shown in FIGS. 4 and 5, the bridge 40 and, accordingly, the rollers 28 are able to be adjusted with respect to the control cams 29 and 31, on the one hand, and 30 and 32, on the other hand, in a relatively simple and reliable manner. After every adjustment operation, the bridge 40 is rigidly clamped in the cavity 41 by means of the screws 42, so that a reliable and exact mounting of the drive members 18 and 21 is assured.

Figure 6:
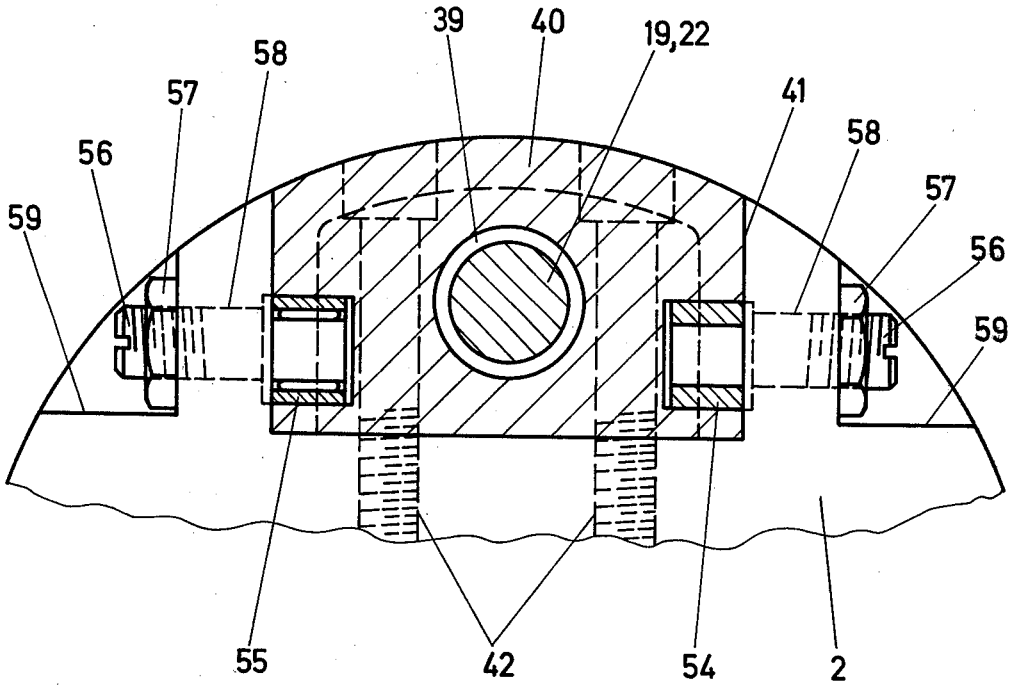
FIG. 6 is an enlarged fragmentary sectional view of a somewhat modified form of the sheet-turning drum of FIG. 1.

For easier shifting or displacement, as shown in FIG. 6, the bridge 40 can be guided in the cavity 41 on slide members 54 or rollers 55. The slide members 54 or rollers 55 are adjustable by means of eccentric bolts 56. After adjustment of the slide members 54 or rollers 55 has been effected, the eccentric bolts 56 are secured against torsion by means of lock nuts 57. The slide members 54 or rollers 55 are disposed pairwise in vicinity of both ends of the bridge 40, the eccentric bolts 56 being rotatably mounted in bores 58 formed in the body of the turning drum 2, and respective recesses 59 being rpovided for the lock nuts 57. By this method of mounting, the bridge 40 is installable playfree in the cavity 41 and is displaceable in a relatively easy manner. After the bridge 40 has been displaced or shifted, it is secured by tightening the screws 42 so that an exact and stable mounting of the drive members 18 and 21 is likewise assured.

There are claimed:

1. Gripper movement changeover device on a sheet-turning drum for perfector printing machines having two drive members for the gripper movement located at opposite ends of the drum, the drive members being pivotable about pivot pins, each of the drive members carrying a roller selectively engageable with either one of two coaxially disposed control cams located adjacent the ends of the drum for following the cams comprising a bridge disposed in a cavity formed in the sheet-turning drum, said bridge extending over the length of the sheet-turning drum, a plate fastened in said cavity and formed with a slot, an eccentric bolt mounted in said bridge and having an eccentric pin engaging in the slot formed in said plate, the drive members being movably mounted on said bridge for displacement together with said bridge axially of the drum, whereby upon rotation of said eccentric bolt against said slot, said bridge is caused to be longitudinally displaced a distance corresponding to the mutual spacing of the control cams of the respective drive members.

2. Device according to claim 1 including axially aligned pivot means disposed in respective end faces of said bridge for mounting said drive members, and torsion bar spring means for stressing said axially aligned pivot means against one another.

3. Device according to claim 1 including a first bearing secured in said cavity, a second bearing secured to said bridge, and a threaded spindle threadedly fastened at one end thereof in said first bearing and rotatably mounted at the other end thereof in said second bearing and secured thereat against axial displacement.

4. Device according to claim 1 including slide means for slidably guiding said bridge in said cavity, eccentric bolt means for adjusting said slide means with respect to said bridge and threaded fastening means for tightly securing said bridge in said cavity.

5. Device according to claim 1 including roller means for rollably guiding said bridge in said cavity, eccentric bolt means for adjusting said roller means, and threaded fastening means for tightly securing said bridge in said cavity.

* * * * *